United States Patent [19]

Keske

[11] 4,191,244

[45] Mar. 4, 1980

[54] MODULAR HEAT EXCHANGER WITH RESILIENT MOUNTING AND SEALING ELEMENT

[75] Inventor: Frank E. Keske, Chilicothe, Ill.

[73] Assignee: Caterpillar Tractor Co., Peoria, Ill.

[21] Appl. No.: 878,124

[22] Filed: Feb. 9, 1978

[51] Int. Cl.[2] ..... F28F 9/26

[52] U.S. Cl. ..... 165/69; 29/157.4; 165/144; 165/175; 285/137 R; 285/162; 285/196; 285/338

[58] Field of Search ..... 285/158, 189, DIG. 19, 285/196, 162, 338, 137 R; 165/76, 82, 173, 175, 178, 144, 174, 69; 16/2; 29/157.4

[56] References Cited

U.S. PATENT DOCUMENTS

| | | | |
|---|---|---|---|
| 1,602,811 | 10/1926 | Clingaman | 165/151 |
| 2,365,046 | 12/1944 | Bottomley | 285/DIG. 19 |
| 2,397,069 | 3/1946 | Young et al. . | |
| 2,904,315 | 9/1959 | Pennella . | |
| 3,048,375 | 8/1962 | Walker . | |
| 3,391,732 | 7/1968 | Murray | 165/76 |
| 3,447,603 | 6/1969 | Jones | 165/178 |
| 3,471,178 | 10/1969 | Roe | 285/137 R |
| 3,583,478 | 6/1971 | Fieni | 165/178 |
| 3,635,283 | 1/1972 | Satchwell | 165/76 |
| 3,750,744 | 8/1973 | Bouras | 165/76 |
| 3,792,729 | 2/1974 | Perry | 165/175 |
| 3,822,741 | 7/1974 | Lippitsch | 165/83 |
| 3,858,291 | 1/1975 | Perpall | 165/69 |
| 4,023,618 | 5/1977 | Kun et al. | 165/175 |
| 4,081,879 | 4/1978 | Rubright | 16/2 |

FOREIGN PATENT DOCUMENTS

| | | | |
|---|---|---|---|
| 488985 | 7/1938 | United Kingdom | 165/76 |
| 724258 | 2/1955 | United Kingdom | 165/175 |

OTHER PUBLICATIONS

Aluminum Radiator Bibs to Succeed Where Others Failed, Product Engineering, Apr., 1976.

*Primary Examiner*—Sheldon Richter
*Attorney, Agent, or Firm*—John L. James

[57] ABSTRACT

A heat exchanger having one or more cooling cores connected between an inlet manifold tank and an outlet manifold tank is provided with a resilient element for mounting the cooling cores to the manifold tanks and sealing the connection therebetween. The resilient mounting and sealing element is formed so as to have a strip portion with at least one opening formed therein to receive the tube of a cooling core and a raised lip portion around the strip portion to provide a damped soft mount. The resilient element also includes a grommet portion around the opening which deforms to provide a liquid or fluid-tight seal between the outside of cooling core tubes and the inside of the manifold tank bores which are adapted to receive the tubes.

6 Claims, 6 Drawing Figures

FIG. 1
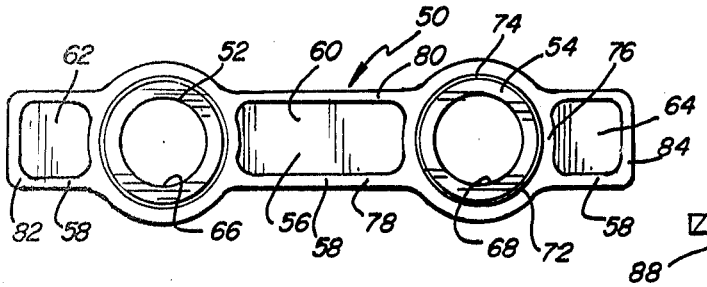
FIG. 3
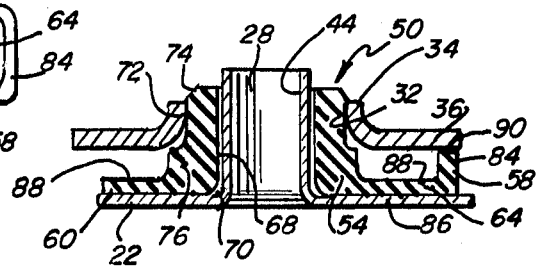
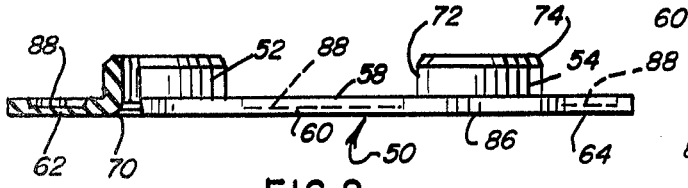
FIG. 2
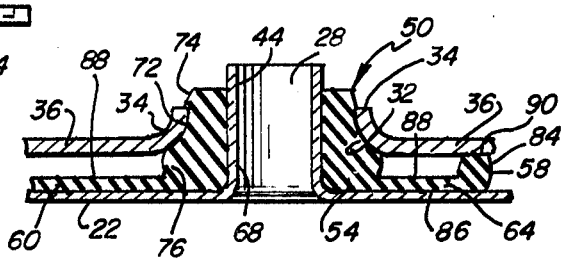
FIG. 4
FIG. 5
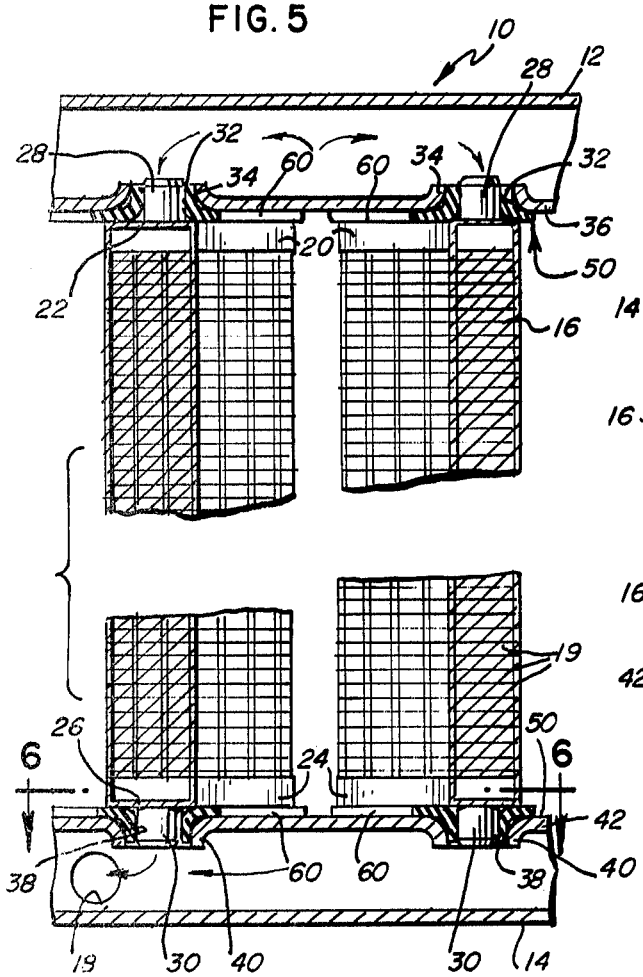
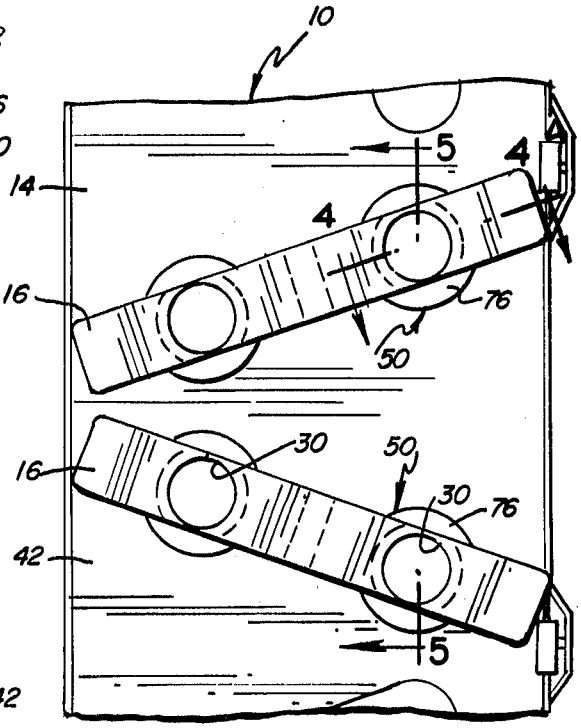
FIG. 6

MODULAR HEAT EXCHANGER WITH RESILIENT MOUNTING AND SEALING ELEMENT

BACKGROUND OF THE INVENTION

1. Field of the Invention

This invention relates to heat exchangers and, more particularly, to a mounting and sealing element for connecting cores to the tanks of the heat exchanger.

2. Description of the Prior Art

Heat exchangers and radiators, and primarily the type of radiators used to cool internal combustion engines either on a moving vehicle or on a fixed stationary frame while usually constructed as single integral units, have been constructed by mounting a plurality of cooling cores between a pair of spaced manifold tanks or by hooking the cooling cores together by hoses. These cooling cores are formed from a tube having fins radiating therefrom and providing means for fluid coolant delivered from the circulating system of the engine to flow from one manifold through the tube into the other manifold. Air flow, often created by a fan or movement of the vehicle, passes through the radiator to absorb heat from the radiating fins thereby reducing the heat of the fluid coolant flowing through the tubes. The cooling cores may be removed individually after one of the manifolds or hoses are disconnected.

It is essential in such radiators to provide a fluid-tight connection between the manifolds and the cooling cores. Oftentimes, the cooling cores are soldered to the manifold tanks. In other constructions, the cooling cores are clamped to the manifold or are provided with grommets or O-rings to provide a sealing capability when the cooling cores are plugged into the manifolds. Because of the high number of seals required, some leakage problems are expected, particularly in the case of O-rings which are not adopted to tolerate much relative motion.

In addition, the heat exchangers must be constructed so that thermal expansion of the cooling cores as the coolant heats up is compensated for. Since the cooling cores are normally made from copper or aluminum which expands more rapidly than the steel frame to which the radiator is bolted, the thermal growth of the radiator is much greater than that of the frame. Hence, solid soldered or clamped connections are not desirable, since they do not readily permit relative movement between the connected components.

Recognizing that vehicle frames distort during operation, the radiator cores have in the past been elastically mounted in some manner to prevent rupture of the radiator cores which might otherwise occur if the cores were rigidly attached to the frame or to the manifold. However, these soft suspensions, which provide a misalignment mount function, may frequently lead to resonant vibration of the radiators. To prevent malfunction of the radiator, the radiator must be isolated against shock and vibration. Large radiators have utilized separate snubbers to prevent excessive vibration amplitudes at resonant speeds, but it is expensive to design and manufacture a snubber to provide the desired damping.

SUMMARY OF THE INVENTION

The present invention is directed to overcoming one or more of the problems as set forth above.

According to the present invention, a resilient mounting and sealing element is disposed between the radiator cooling cores and the manifold tanks and is configured to provide a seal between the cooling core and the manifold tank and to provide a soft suspension for the radiator core which is damped to prevent build-up of excessive vibration amplitudes.

In an exemplary embodiment of the invention, the mounting and sealing element integrally includes a strip portion, a grommet portion defining a bore through the strip portion and extending therefrom, and a lip portion formed at the edges of the element and extending from the strip portion. The grommet portion provides a seal between the outer diameter of the cooling core tube and the inner diameter of the bore leading to the interior of the manifold tanks. The lip portion is placed in a stressed state by compressing the manifold tank and the cooling core together. The resilient element thereby provides a soft resilient mount to compensate for thermal expansion, while the lip portion, which becomes relatively rigid when deflected sufficiently, prevents excessive vibration when the apparatus is operated at some resonant speed.

Further, the mounting and sealing element allows misalignment of the joint between the manifold tanks and the cooling cores and simultaneously allows the removal, service and/or installation of each cooling core module without disturbing the complete radiator core assembly.

BRIEF DESCRIPTION OF THE DRAWINGS

The details of construction and operation of the invention are more fully described with reference to the accompanying drawings which form a part hereof and in which like reference numerals refer to like parts throughout.

In the drawings:

FIG. 1 is a plan view showing a preferred embodiment of a mounting and sealing element constructed in accordance with the invention;

FIG. 2 is a side elevational view partially in section of the mounting and sealing element shown in FIG. 1;

FIG. 3 is a cross-sectional view of the mounting and sealing element in an unstressed state between a core element and a tank;

FIG. 4 is a cross-sectional view similar to FIG. 3 but showing the mounting and sealing element in a stressed state;

FIG. 5 is a partial, cross-sectional view of a radiator incorporating the invention; and, FIG. 6 is a cross-sectional view of the radiator taken along line 6—6 of FIG. 5 showing the orientation of the cooling cores.

DESCRIPTION OF THE PREFERRED EMBODIMENT

A portion of a radiator or heat exchanger, generally designated 10, is illustrated in FIGS. 5 and 6. The heat exchanger 10 includes a header or inlet manifold tank 12, a bottom or outlet manifold tank 14, and a plurality of cooling modules or cores 16. Liquid coolant is delivered by a pump (not shown) to the interior of the inlet tank 12 via an inlet (not shown). The liquid coolant, which enters at high temperature, is circulated through the cooling cores 16, so that the temperature of the coolant is reduced. The cooled coolant flows from the cooling cores 16 into the interior of the outlet tank 14 and exits through an outlet conduit 18.

The cooling cores 16 are of conventional design and have through tubes to which a plurality of radiating fins 19 have been attached. Each cooling core 16 has a top collector tank 20 with a top plate 22 and a bottom collector tank 24 with a bottom plate 26 which have, respectively, upwardly and downwardly extending inlet and outlet tubes 28 and 30. The inlet and outlet tubes 28 and 30, in turn, are adapted to fit within the openings 32 formed in the thickened boss portions 34 of the bottom wall 36 of the inlet tank 12 and in the openings 38 formed thickened boss portions 40 of the top wall 42 of the outlet tank 14. The tubes 28 and 30 of each cooling core 16 lie along a pair of lines extending between the top and bottom of the core. While a radiator having dual inlet and outlet core tubes is shown herein, it should be clear that each core may have only one inlet tube and one outlet tube or may have two, or more than two, inlet and outlet tubes depending on flow requirements. As shown in FIG. 6, the cooling cores 16 are angularly oriented relative to one another to present increased surface area to the air flow. It is to be understood that the cores 16 could lie parallel to each other or have a different orientation without departing from the invention.

Hot coolant flows into the inlet tank 12 and into the openings 44 of the tubes 28. The heated fluid coolant flows through tubes in the cooling cores 16, where the heat in the coolant is radiated to the radiating fins 19 and is removed by the passage of air over, around and between the tubes and fins. The coolant, with a reduced temperature, is collected in the outlet tank 14 where it is pumped back to the engine.

A resilient elastomeric element, generally designated 50, is placed between the cooling cores 16 and the respective inlet and outlet tanks 12 and 14 to provide a seal therebetween, to provide a soft mount to isolate against shock and vibration and to provide compensation for thermal expansion of the cores as heat is absorbed. Similar resilient elements are utilized at each end of a cooling core 16.

The resilient element 50 integrally includes a pair of raised grommet portions 52 and 54, a strip portion 56 spanning the grommet portions 42 and 54, and a raised lip 58 extending around the edge of the strip portion 56 and the grommet portions 52 and 54.

The relatively flat strip portion 56 has a center portion 60 spanning the distance between the pair of grommet portions 52 and 54 and has a pair of end portions 62 and 64 extending longitudinally beyond the grommet portions 52 and 54, respectively. As seen in FIGS. 1 and 2, the strip portion 56 therefore assumes an elongated, generally rectangular configuration.

The grommet portions 52 and 54 are annularly formed and define bores therethrough, designated 66 and 68, which are adapted to receive the tubes 28,28 or 30,30. The grommet portions 52 and 54 include curved edges 70 at the lower end of the bores 66 and 68 to facilitate insertion of a tube therein. To facilitate insertion of the grommet portions 52 and 54 into the manifold tank bores 32,32 or 38,38, the upper end of the outer cylindrical surfaces 72 thereof includes a cammed edge 74. The outer surfaces 72 may be circumferentially grooved (not shown) without a reduction in reliability to further facilitate insertion thereof into the manifold tank bores.

The lip portion 58 includes a part 76 formed at the junction between the strip portion and the grommet portion surrounding each of the grommet portions 52 and 54, parts 78 and 80 extending along the edge of the center strip portion 60, and parts 82 and 84 extending around the end strip portions 62 and 64, respectively. As a result, the resilient element 50 has a flat surface 86 on a bottom wall and a built-up surface on the opposite or upper wall defining recesses 88, one between the grommet portions 52 and 54 and one at each end. This permits sufficient deflection or compression of the lip portion 58 unobtainable with a solid structure not embodying a lip.

As seen in FIGS. 3 and 4, for example, the grommet portion 54 of the resilient element 50 is placed over the tube 28 of a cooling core 16 to place the flat surface 86 against the plate 22 thereof. Then, the grommet portion 54 is inserted into the opening 32 in the inlet tank 12 so that the upper edge 90 of the lip portion 58 seats against the wall 36 of the inlet tank 12. When the tank 12 is moved forcefully against the cooling core 16 in the direction of the axis of the tube 28, the resilient element 50 is placed in a stressed (compressed) condition, whereupon the lip part 76 will deform to define a seat for the tank bore edge and the grommet portion 54 will be deformed to provide a tight seal against coolant leaks.

In addition, the lip portion 58 around the perimeter of the strip portion 56 and the lip part 76 around the grommet portion 54 will also deform as seen in FIG. 4 to act as a simple compression mount. The height and width of the lip portion 58 (height-to-width ratio as well as the absolute dimension) and the total length of the lip portion 58 determine the spring rate and the relative travel between the cooling core 16 and the inlet tank 12. As is well-known, such a mounting becomes quite rigid when deflected sufficiently, thereby preventing excessive vibration. This type of mounting provides the damping necessary to prevent build-up of excessive vibration amplitudes during operation at resonant speeds.

It should be apparent that there may be a plurality of such resilient members, e.g., one for each tube. In contrast, there need only be a single element for mounting all of the cores to one manifold tank. The function of the resilient mounting and sealing element is similar regardless. In addition, it is noted that the cooling cores can be formed with relatively short inlet and outlet tubes and that the manifold tanks need not be soldered or otherwise rigidly fixed to the cooling cores.

Hence, this design and construction of a heat exchanger is suitably adapted for use with a liquid-cooled internal combustion engine of a land vehicle, the engine of a stationary installation or the like where air is forced or drawn over the cooling cores. In the event one of the cores becomes defective or leaks, it is only necessary to unclamp the top tank 12, raise it from the cores, remove and replace the defective core and reclamp the unit, all in a relatively short time and in a simple fashion. Heretofore, it was necessary to unsolder all the connections between the cores and the tank so as to be able to lift the top tank for repair and replacement whereupon the cores and tank all had to be resoldered.

The embodiments of the invention in which an exclusive property or privilege is claimed are defined as follows:

1. In a cooling system having a header tank, an outlet tank, and at least one cooling core extending between the header tank and the outlet tank, the improvement comprising:

a means for mounting the core to a selected one of said tanks and providing a seal between the core and the selected tank, said means including an elastomeric element between the core and the selected tank integrally including a strip portion having a bore therethrough and being of a construction sufficient for receiving a selected portion of the cooling core therein, and a raised lip portion around the edge of the strip portion and the edge of the bore, said raised lip portion being deformed when compressed between the core and the selected tank to seal the connection between the selected portion of the core and the selected tank and to provide a damped resilient mount therebetween.

2. A heat exchanger comprising:

first and second fluid tanks;

a cooling core axially positioned between the fluid tanks, one of said first fluid tank and core having a first bore and the other having a first protruding tube insertable in the first bore, one of said second fluid tank and core having a second bore and the other having a second protruding tube insertable in the second bore, said first and second fluid tanks being axially movable one relative to the other; and means for connecting the core and tanks and providing a damped, resilient sealing mount therebetween and preventing direct contact between the core and fluid tanks, said means including:

a first elastomeric element having a strip portion and a raised lip portion and being positioned between the core and first tank, said strip portion defining an opening therethrough of a size sufficient for receiving the first protruding tube, said lip portion extending around the edge of the strip portion and the edge of the opening and being of a construction sufficient for elastically deforming when compressed between the core and first tank for sealing the connection between the first tank and core and for providing a damped, resilient mount therebetween; and a second elastomeric element having a strip portion and a raised lip portion and being positioned between the core and second tank, said strip portion defining an opening therethrough of a size sufficient for receiving the second protruding tube, said lip portion extending around the edge of the strip portion and the edge of the opening and being of a construction sufficient for elastically deforming when compressed between the core and second tank for sealing the connection between the second tank and core and for providing a damped, resilient mount therebetween.

3. A heat exchanger, as set forth in claim 2, wherein the core is removable from between the first and second tanks when the axial distance between the tanks exceeds a preselected value.

4. A heat exchanger, as set forth in claim 2, wherein the core is insertable between the tanks and removable from between the tanks in response to controllably changing the axial distance between the tanks without removing the elastomeric elements.

5. A cooling system, comprising:

a first radiator manifold having a plurality of bores communicating with the interior thereof;

a second radiator manifold having a plurality of bores communicating with the interior thereof;

at least one radiator core having an inlet collector tank at one end, an outlet collector tank at the other end, at least two inlet tubes each extending from the inlet tank into the interior of said first manifold through a respective bore thereof and at least two outlet tubes each extending from the outlet tank into the interior of said second manifold through a respective bore thereof forming a fluid coolant flow path from said first manifold to said second manifold through said core; and an integrally formed elastomeric mounting and sealing element at each end of said core between the respective collector tanks and manifolds, each of said elastomeric elements having a strip portion defining a bore for each tube through which the tube extends and a raised lip compressed during assembly to provide a damped resilient mount between the core and the manifold.

6. A cooling system, comprising:

a first radiator manifold having a plurality of bores communicating with the interior thereof;

a second radiator manifold having a plurality of bores communicating with the interior thereof;

a first radiator core having an inlet collector tank at one end, an outlet collector tank at the other end, at least one inlet tube extending from the inlet tank into the interior of said first manifold through one bore thereof and at least one outlet tube extending from the outlet tank into the interior of said second manifold through one bore thereof forming a fluid coolant flow path from said first manifold to said second manifold through said first core;

a second radiator core angularly oriented relative to said first radiator core and having an inlet collector tank at one end, an outlet collector tank at the other end, at least one inlet tube extending from the inlet tank into the interior of said first manifold through one bore thereof and at least one outlet tube extending from the outlet tank into the interior of said second manifold through one bore thereof forming a fluid coolant flow path from said first manifold to said second manifold through said second core; and an integrally formed elastomeric mounting and sealing element at each end of each of said first and second cores between the respective collector tanks and manifolds, each of said elastomeric elements having a strip portion defining a bore through which a tube extends and a raised lip compressed during assembly to provide a damped resilient mount between the core and the manifold.

* * * * *